United States Patent [19]

Nakamura

[11] Patent Number: 4,468,132

[45] Date of Patent: Aug. 28, 1984

[54] WHOLE BODY SWINGABLE CLOCK

[75] Inventor: Norihiko Nakamura, Saitama, Japan

[73] Assignee: Rhythm Watch Co., Ltd., Tokyo, Japan

[21] Appl. No.: 487,100

[22] Filed: Apr. 21, 1983

[30] Foreign Application Priority Data

Apr. 26, 1982 [JP] Japan ..... 57-69815
Apr. 26, 1982 [JP] Japan ..... 57-69816

[51] Int. Cl.[3] ..... G04B 19/00; G04C 23/02

[52] U.S. Cl. ..... 368/76; 368/88; 368/134; 368/179

[58] Field of Search ..... 368/62, 88, 76, 134–137, 368/165–166, 179–181, 276, 316–317

[56] References Cited

U.S. PATENT DOCUMENTS 2,323,796 7/1943 Cole ..... 368/134
3,750,386 8/1973 Harting ..... 368/166
3,990,226 11/1976 Fehrenbacher ..... 368/134
4,241,437 12/1980 Ashida ..... 368/134
4,395,137 7/1983 Wiley ..... 368/179

*Primary Examiner*—Vit W. Miska
*Attorney, Agent, or Firm*—Koda and Androlia

[57] ABSTRACT

A whole body swingable clock wherein a clock body itself swings. This whole body swingable clock includes: a clock body swingably supported on a pendulum fulcrum and solidly secured thereto with a clock mechanism case housing therein a movement case; and a stationary receiving plate provided thereon with a magnet or a driving coil to be electromagnetically connected to a driving coil or a magnet provided on the movement case for generating a swinging driving force in the clock body. In this whole body swingable clock, the stationary receiving plate with the magnet or the driving coil is housed in a space formed in the movement case, whereby the clock body can swing with the stationary receiving plate with the magnet or the driving coil being hardly exposed to outside from the clock body.

3 Claims, 13 Drawing Figures

WHOLE BODY SWINGABLE CLOCK

BACKGROUND OF THE INVENTION (1) Field of the Invention

This invention relates to whole body swingable clocks, and more particularly to a whole body swingable clock wherein a clock body swings by itself.

(2) Description of the Prior Art

Recently, there have been widely put to practical use whole body swingable clocks wherein the clock body itself swings on a fulcrum of pendulum, for the purpose of decoration.

The whole body swingable clock of the type described is constructed such that the clock body is swingably supported on the fulcrum of pendulum of a stationary support member, a clock mechanism case incorporating therein a movement case is affixed to the clock body, and a knife edge of the clock body is normally supported by a V-groove of the stationary support member. And, the swinging motion of the clock body is sustained by an electromagnetic driving force generated between a driving coil or a magnet provided on the clock body and a magnet or driving coil on a stationary receiving plate provided on the stationary support member.

However, in the conventional whole body swingable clock as described above, the stationary receiving plate provided thereon with the magnet or driving coil is disposed outside the clock body. For example, the stationary receiving plate is solidly secured to a wall of a house, or constituted by a receiving plate supported on hands of a figure of a goddess or the like serving as a pedestal, and the stationary receiving plate has been exposed to outside from the clock body. Because of this, when the clock body is swinging, the stationary receiving plate and the magnet, or the driving coil is exposed to a user or users, thus spoiling the appearance of the clock to a considerable extent.

SUMMARY OF THE INVENTION

The present invention has been developed to obviate the above-described disadvantage of the prior art and has as its object the provision of a whole body swingable clock wherein a clock body swings with a stationary receiving plate and a magnet, or a driving coil being hardly exposed to outside from a clock body.

DETAILED DESCRIPTION OF THE PREFERRED EMBODIMENTS

Description will hereunder be given of the preferred embodiments of the present invention with reference to the drawings.

(1) The first embodiment

Figure 1:
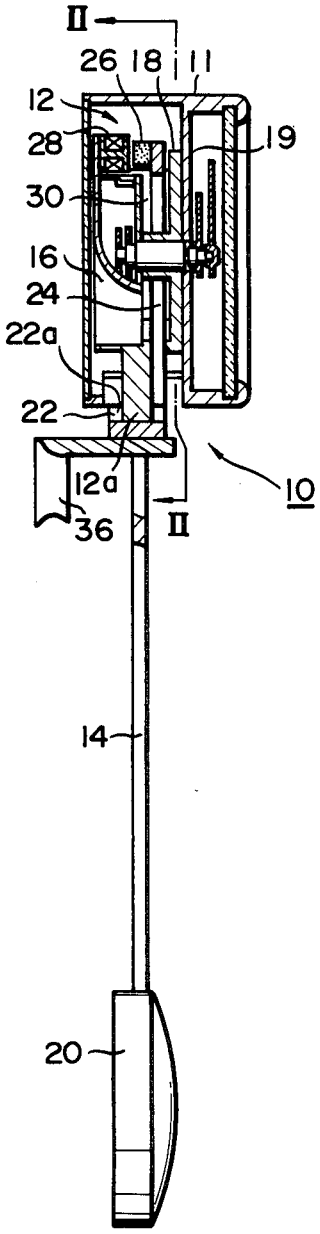
FIG. 1 is an explanatory view showing a first preferred embodiment of the whole body swingable clock according to the present invention.
Figure 2:
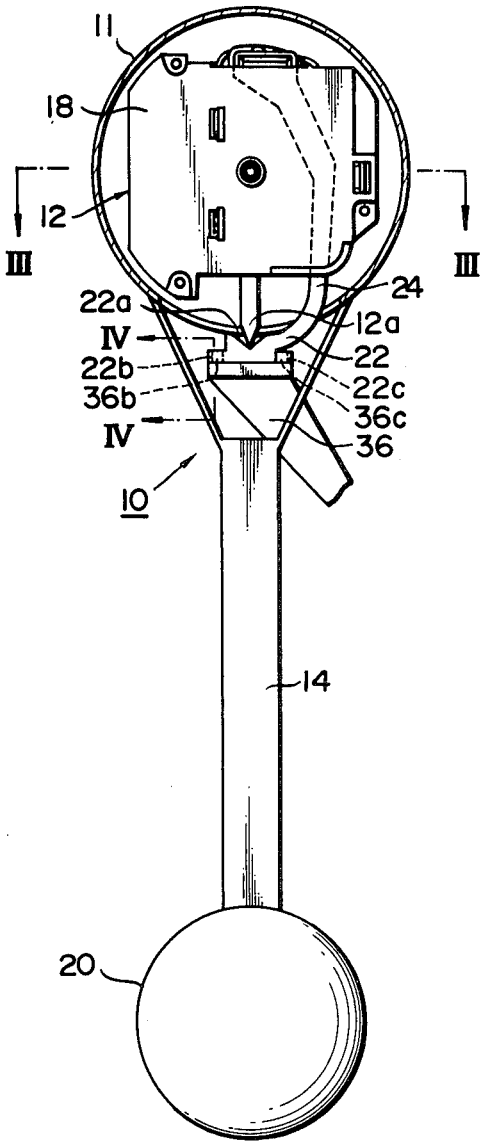
FIG. 2 is a sectional view taken along the line II—II in FIG. 1.
Figure 3:
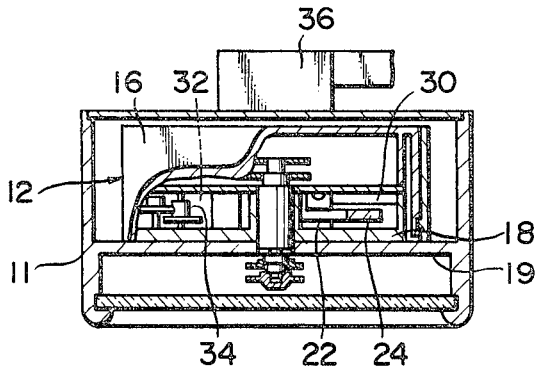
FIG. 3 is a sectional view taken along the line III—III in FIG. 2.

FIG. 1 shows a preferred embodiment of the whole body swingable clock according to the present invention, FIG. 2 shows a section of FIG. 1 and FIG. 3 shows a section of FIG. 2.

In the drawing, a clock body 10 swingably supported on a pendulum fulcrum is provided in the upper thereof with a clock mechanism case 11 and in the lower portion thereof with a swingable portion 14. The clock mechanism case 11 houses therein a movement case 12 including a clock mechanism portion 16 and an under plate 18 at the side of a dial plate. A predetermined time is displayed on the dial plate 19 by the clock mechanism case 11, and the swingable portion 14 is solidly secured at the lower portion thereof with a pendulum bob 20.

The clock body 10 is swingably supported on the pendulum fulcrum of a stationary support member 22, and a knife edge 12*a* of the movement case 12 is supported by a V-groove 22*a* of the stationary support member 22. Furthermore, a stationary receiving plate 24 is projected from the upper surface of the stationary support member 22, a magnet 26 is affixed to the stationary receiving plate 24, and a driving coil 28 for being electromagnetically connected to the magnet 26 to generate a swinging driving force in the clock body 10 is affixed to the movement case 12 of the clock mechanism case 11. In consequence, the clock body 10 can sustain the swinging motion relative to the stationary support member 22 due to an electromagnetic driving force between the magnet 26 and the driving coil 28.

The present invention features that the stationary receiving plate with the magnet or the driving coil is housed in a space between the clock mechanism portion of the movement case and the under plate at the side of the dial plate, and in the embodiment, a space 30 is formed between the clock mechanism portion 16 of the movement case 12 and the under plate 18 at the side of the dial plate, and the stationary receiving plate 24 with the magnet 26 is housed in the aforesaid space 30.

In consequence, the clock body 10 can swing with the stationary receiving plate 24 with the magnet 26 being hardly exposed to outside from the clock body 10. Additionally, hands of the clock can be checked up from the rear surface of the clock mechanism portion 16 (i.e., the rear surface of the clock body 10) without being interfered by the stationary receiving plate 24.

Moreover, the present invention features that an additional mechanism of the clock is provided in a space which is the space formed between the clock mechanism portion of the movement case and the under plate at the side of the dial plate, and simultaneously, in a space not interfering with the swing of the clock body, and in the embodiment, as shown in FIG. 3, gear trains, levers and the like of an additional mechanism 34 including a timer, an alarm, a time telling mechanism and the like are provided in a space between the clock mechanism portion 16 of the movement case 12 and the under plate 18 at the side of the dial plate, and simultaneously, in a space 32 not interfering with the swing of the clock body 10.

In consequence, the provision of the additional mechanism 34 in the space 32 can eliminate a dead space between the clock mechanism portion 16 and the under plate 18 at the side of dial plate, and achieves the reduction of the movement case in its thickness. Further, the clock mechanism portion 16 performing only the time display can be applied to all of the whole body swingable clocks. More specifically, the additional mechanism 34 provided in the space 32 can be divided into a timer, an alarm and a time telling mechanism, respectively, depending on the type of the whole body swingable clocks. However, the clock mechanism portion 16 is applicable to all types of the whole body swingable clocks, thus enabling to realize the mass production of the clocks.

Figure 4:
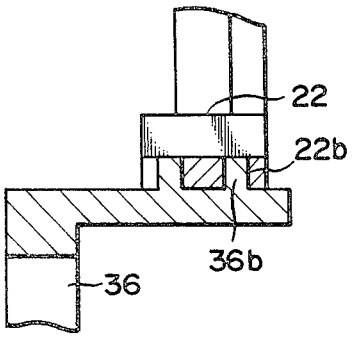
FIG. 4 is a sectional view taken along the line IV—IV in FIG. 2.

FIG. 4 shows a section of FIG. 2, wherein the stationary support member 22 is coupled to a support arm 36 of the figure of goddess, not shown, serving as a pedestal of the clock. More specifically, projections **36*b* and 36*c* of the support arm 36 are coupled into recesses 22*b* and 22*c* of the stationary support member 22. During transportation of the clock, the support arm 36 is removed from the stationary support member 22, so that the clock body 10** and the figure of the goddess can be disassembled from each other, thereby enabling to facilitate the transportation of the clock, and moreover, to prevent the clock from being damaged during transportation.

As has been described hereinabove, according to the present invention, the stationary receiving plate with the magnet or the driving coil is housed in the space between the time mechanism portion and the under plate at the side of the dial plate, so that the clock body can swing with the stationary receiving plate with the magnet or the driving coil being hardly exposed to outside from the clock body. In consequence, during the swing of the clock body, the stationary receiving plate with the magnet or the driving coil is not exposed to the user or users, so that the appearance of the clock cannot be spoiled. Furthermore, the hands of the clock are checked up from the rear surface of the clock mechanism portion without being interfered by the stationary receiving plate.

Further, according to the present invention, the additional mechanism of the clock is provided in the space between the clock mechanism portion and the under plate at the side of the dial plate, and simultaneously, in a space not interfering with the swing of the clock body, so that the reduction of the movement case in its thickness can be achieved and the mass production of the clocks can be realized.

(2) The second embodiment

Description will hereunder be given of the second embodiment of the present invention with reference to the drawings.

Figure 5:
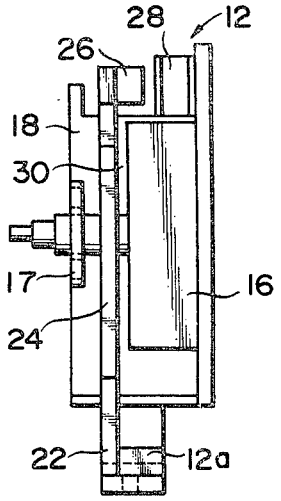
FIG. 5 is a side view showing a movement case in a second embodiment of the present invention.
Figure 6:
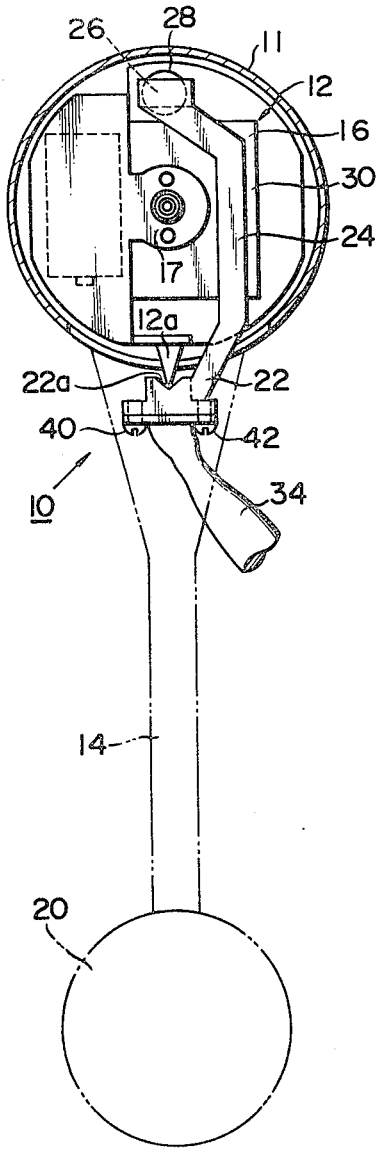
FIG. 6 is an explanatory view showing a state where the movement case shown in FIG. 5 is housed in a clock mechanism case.
Figure 7:
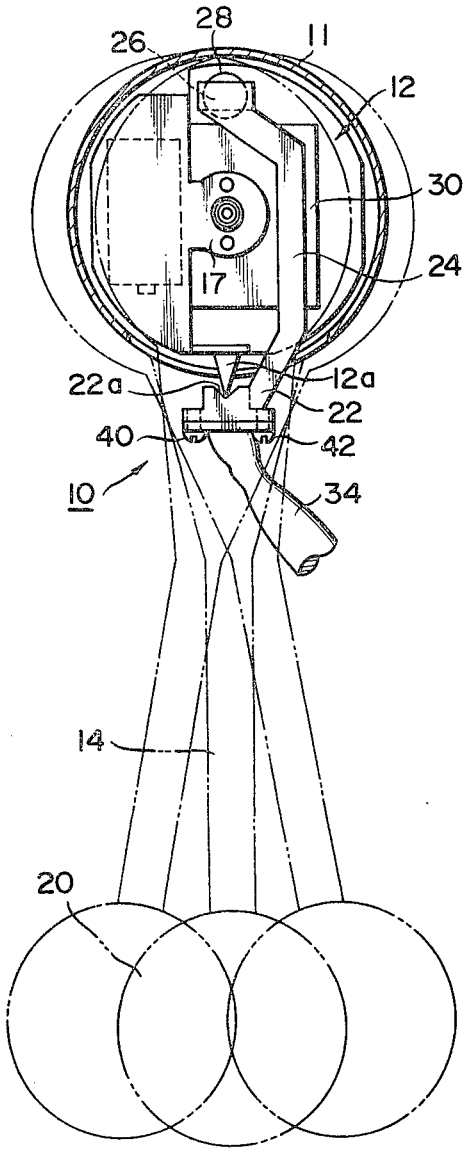
FIG. 7 is an explanatory view illustrating the movement case shown in FIG. 6 in an actuated position.

FIG. 5 shows a side surface of the movement case in this embodiment, FIG. 6 shows the state where the movement case shown in FIG. 5 is housed in the clock mechanism case, and FIG. 7 shows the swinging motion of the clock body.

In the drawing, the under plate 18 at the side of the dial plate is removed from the movement case 12. The stationary receiving plate 24 with the magnet 26 is housed in the space 30 between a mounting portion 17 for mounting the clock mechanism case to the dial plate 19 and the clock mechanism portion 16, at one side of the movement case 12 shown in FIG. 5. In consequence, it is understood from FIGS. 5 and 7 that the clock body 10 can swing with the stationary receiving plate 24 with the magnet 26 being hardly exposed to outside from the clock body 10.

Furthermore, in FIGS. 6 and 7, the stationary support member 22 and the support arm 36 of the figure of goddess serving as the pedestal of the clock are closely affixed to each other through set screws 40 and 42, so that the stationary support member 22 and the support arm 36 can be reliably affixed to each other, and moreover, the stationary support member 22 and the support arm 36 can be easily disassembled from each other.

(3) The third embodiment

Description will now be given of the third embodiment of the present invention with reference to the drawings.

Figure 8:
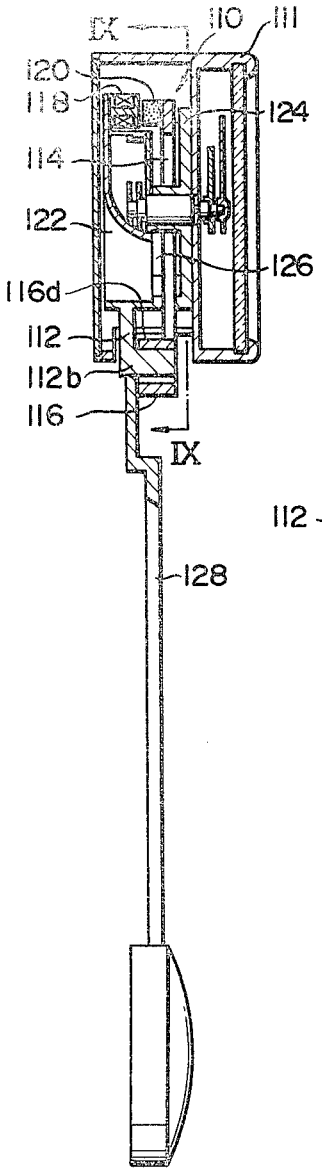
FIG. 8 is an explanatory view showing the case where a third embodiment of the clock according to the present invention is used as a pendulum clock.
Figure 9:
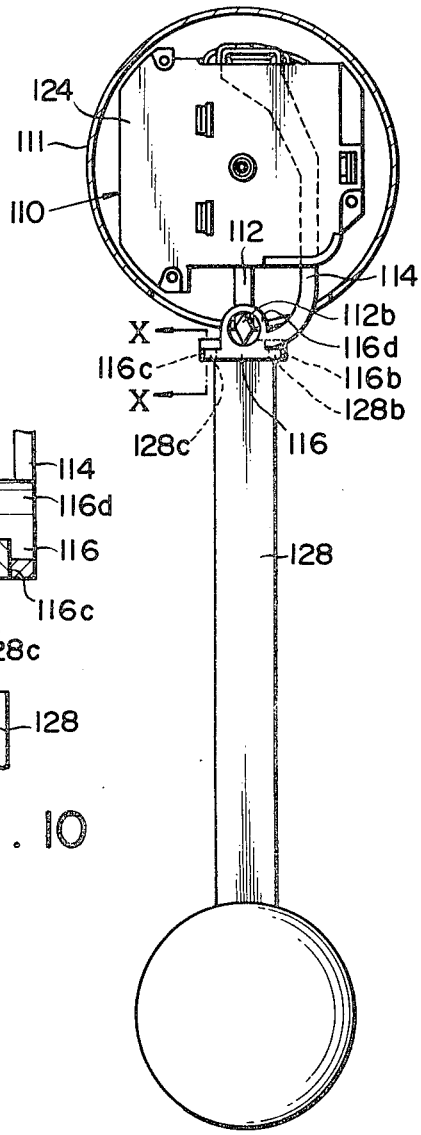
FIG. 9 is a sectional view taken along the line IX—IX in FIG. 8.

FIG. 8 shows the third preferred embodiment of the clock according to the present invention, and FIG. 9 shows a section of FIG. 8.

In the embodiment, a support portion 112 of a movement case 110 housed and fixed in a clock mechanism case 111 has a support pillar **112*b* formed into a square pillar shape, while, a receiving portion 116 of an electromagnetic drive receiving plate 114 has a ring-shaped support frame 116*d* formed into a ring shape, whereby the support pillar 112*b* is engaged with the ring-shaped support frame 116*d*, so that the electromagnetic drive receiving plate 114 can swing relative to the movement case 110**.

Furthermore, a driving coil 118 is affixed to the other end of the movement case 110 opposite to the support portion 112 thereof, while, a magnet 120 to be electromagnetically connected to the driving coil 118 is affixed to the other end of the electromagnetic drive receiving plate 114 opposite to the receiving portion 116 thereof, so that an electromagnetic driving force can be generated between the driving coil 118 and the magnet 120.

Then, if the movement case 110 is held stationary and the electromagnetic drive receiving plate 114 is swung, then the clock can be used as a pendulum clock. Whereas, if the electromagnetic drive receiving plate 114 is held stationary and the movement case 100 is swung, then the clock is used as a whole body swingable clock. In consequence, one and the same movement case 110 or electromagnetic drive receiving plate 114 can be commonly used in a pendulum clock and a whole body swingable clock.

Furthermore, in the embodiment, since the support pillar **112*b* and the ring-shaped support frame 116*d* are engaged with each other, the support pillar 112*b* of the support portion 112** may be directed downwardly no matter whether the clock is used as the pendulum clock or the whole body swingable clock.

Additionally, the movement case 110 housed and fixed in the clock mechanism case 111 is provided therein with a clock mechanism portion 122 and an under plate 124 at the side of a dial plate, a predetermined time is displayed by the clock mechanism case 111, and the electromagnetic drive receiving plate 114 and the magnet 120 are housed in a space 126 between the clock mechanism portion 122 and the under plate 124 at the side of the dial plate. In consequence, during swing of the electromagnetic drive receiving plate 114 or the movement case 110, the electromagnetic drive receiving plate 114 and the magnet 120 are hardly exposed from the clock mechanism 111.

Description will hereunder be given of the cases where the clocks shown in the embodiments are used as the pendulum clock and a whole body swingable clock, respectively.

FIGS. 8 and 9 show the case where the clock is used as the pendulum clock.

Figure 10:
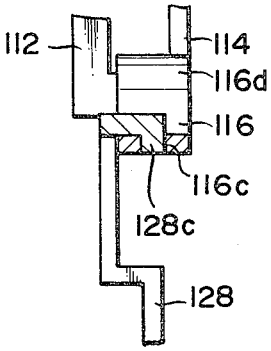
FIG. 10 is a sectional view taken along the line X—X in FIG. 9.

In FIGS. 8 and 9, the movement case 110, with the support pillar **112*b* being directed downwardly, is solidly secured to a wall or the like through the clock mechanism case 111, the electromagnetic drive receiving plate 114 is used as a swing receiving plate and a pendulum 128 is fixed to and suspended from the bottom portion of the electromagnetic drive receiving plate 114. In addition, the fixing and suspending of the pendulum 128 is carried out such that projections 128*b* and 128*c* are coupled into recesses 116*b* and 116*c* of a receiving portion 116 of the electromagnetic driving receiving plate 114 as shown in FIG. 10. With this arrangement, the electromagnetic drive receiving plate 114 is swingably supported on the pendulum fulcrum of the movement case 110, and the electromagnetic drive receiving plate 114 can sustain the swinging motion relative to the movement case 110 by an electromagnetic driving force between the driving coil 118 and the magnet 120. In consequence, the electromagnetic drive receiving plate 114 and the pendulum 128** can be swung, so that the clock can be used as the pendulum clock.

Figure 11:
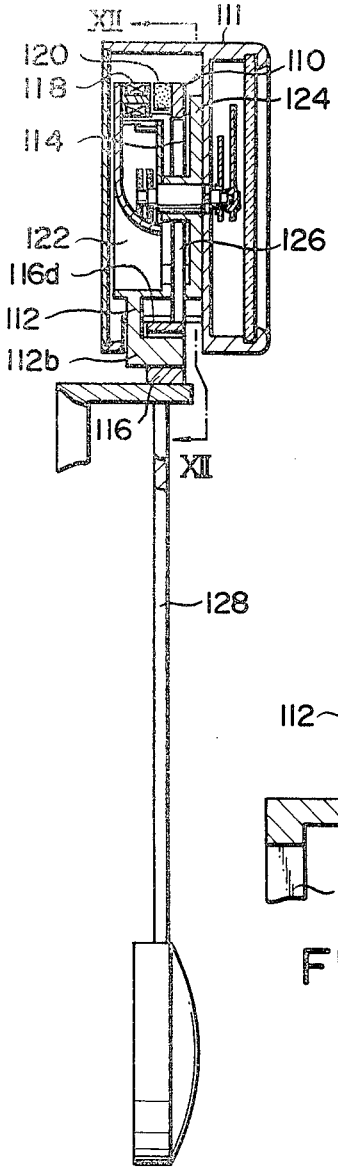
FIG. 11 is an explanatory view showing the case where the third embodiment of the clock according to the present invention is used as a whole body swingable clock.
Figure 12:
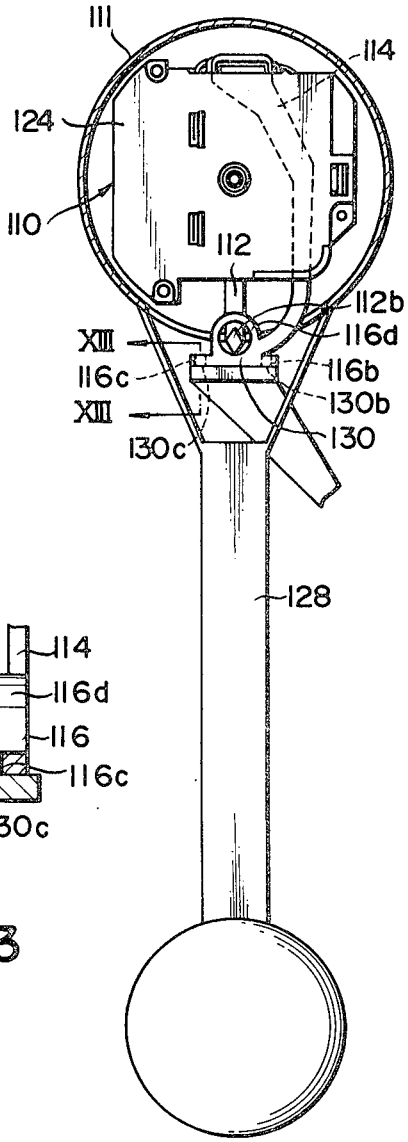
FIG. 12 is a sectional view taken along the line XII—XII in FIG. 11.

FIGS. 11 and 12 show the case where the clock is used as the whole body swingable clock.

Figure 13:
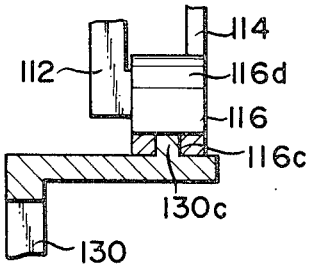
FIG. 13 is a sectional view taken along the line XIII—XIII in FIG. 12.

Also in FIGS. 11 and 12, in the same manner as in FIGS. 8 and 9, the electromagnetic drive receiving plate 114, with the support pillar **112*b* being directed downwardly, is fixed. In this embodiment, as shown in FIG. 13, projections 130*b* and 130*c* of a support arm 130 of the figure of goddess, not shown, serving as a pedestal are coupled into the recesses 116*b* and 116*c* of the receiving portion 116 of the electromagnetic drive receiving plate 114, so as to solidly secure the electromagnetic drive receiving plate 114 to the support arm 130. Further, the pendulum 128 is fixed to and suspended from the bottom portion of the clock mechanism case 111 housing and fixing therein the movement case 111. With this arrangement, the movement case 110 is swingably supported on the pendulum fulcrum of the electromagnetic drive receiving plate 114, and the movement case 110 and the pendulum 128 solidly secured to the clock mechanism case 111 housing and fixing therein the movement case 110 can sustain the swinging motion relative to the electromagnetic drive receiving plate 114 by an electromagnetic driving force between the driving coil 118 and the magnet 120**.

As described above, according to the third embodiment of the present invention, one and the same movement case 110 or electromagnetic drive receiving plate 114 is commonly used, so that the clock can be used as the pendulum clock or the whole body swingable clock. Further, in the third embodiment, the support pillar **112*b* of the support portion 112** as being directed downwardly can be commonly used in the pendulum clock and the whole body swingable clock.

Furthermore, in the third embodiment, in the same manner as in the first embodiment, the electromagnetic drive receiving plate 114 and the magnet 120 provided thereon are housed in the space 126 between the clock mechanism portion 122 and the under plate 124 at the side of the dial plate, so that the swinging motion of the pendulum or the whole body swinging of the clock can be performed with the electromagnetic drive receiving plate 114 with the magnet 120 being hardly exposed to outside from the clock mechanism case 111.

As has been described hereinabove, in the clock according to the embodiments of the present invention, one and the same movement case or electromagnetic drive receiving plate is commonly used, so that the clock can be used as the pendulum clock and the whole body swingable clock.

What is claimed is:

1. A whole body swingable clock comprising: a clock body swingably supported on a pendulum fulcrum and solidly secured thereto with a clock mechanism case housing therein a movement case; and a stationary receiving plate provided thereon with a magnet or a driving coil to be electromagnetically connected to a driving coil or a magnet provided on said movement case for generating a swinging driving force in said clock body; wherein the stationary receiving plate with the magnet or the driving coil is housed in a space formed in said movement case, whereby said clock body can swing with the stationary receiving plate with the magnet or the driving coil being hardly exposed to outside from said clock body.

2. A whole body swingable clock as set forth in claim 1, wherein the stationary receiving plate with the magnet or the driving coil is housed in the movement case and in a space between a portion for mounting the clock mechanism case to a member at the side of a dial plate and the clock mechanism portion.

3. A whole body swingable clock as set forth in claim 1, wherein the stationary receiving plate and the magnet, or the driving coil is housed in a space between a clock mechanism portion of the movement case and an under plate at the side of a dial plate, whereby the clock body can swing with the stationary receiving plate with the magnet or the driving coil being hardly exposed to outside from the clock body, and further, an additional mechanism of the clock is disposed in a space not interfering the swing of the clock body.

* * * * *